US009901139B2

(12) United States Patent
Bardini et al.

(10) Patent No.: US 9,901,139 B2
(45) Date of Patent: Feb. 27, 2018

(54) STRAP SECURING SYSTEM, E.G., FOR ARTICLES OF FOOTWEAR AND OTHER FOOT-RECEIVING DEVICES

(71) Applicant: NIKE, Inc., Beaverton, OR (US)

(72) Inventors: Alex Bardini, Beaverton, OR (US); Cheresse Thornhill, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 531 days.

(21) Appl. No.: 14/530,199

(22) Filed: Oct. 31, 2014

(65) Prior Publication Data

US 2016/0120264 A1 May 5, 2016

(51) Int. Cl.

| | |
|---|---|
| ***A43B 3/00*** | (2006.01) |
| ***A43B 7/14*** | (2006.01) |
| ***A43B 13/14*** | (2006.01) |
| ***A43C 11/14*** | (2006.01) |
| ***A43C 1/00*** | (2006.01) |

(52) U.S. Cl.

CPC ..... *A43C 1/00* (2013.01); *A43C 11/14* (2013.01); *A43C 11/1493* (2013.01)

(58) Field of Classification Search

CPC ... A43C 11/14; A43C 11/1493; A43C 11/002; A43C 11/004; A43C 1/00

See application file for complete search history.

(56) References Cited

U.S. PATENT DOCUMENTS

| | | | |
|---|---|---|---|
| 4,079,527 | A | 3/1978 | Antonious |
| 4,114,297 | A | 9/1978 | Famolare, Jr. |
| 4,282,657 | A | 8/1981 | Antonious |
| 4,296,558 | A | 10/1981 | Antonious |

(Continued)

FOREIGN PATENT DOCUMENTS

| | | | |
|---|---|---|---|
| CN | 202760295 | U | 3/2013 |
| EP | 1283018 | A2 | 2/2003 |

(Continued)

OTHER PUBLICATIONS

Tsukihoshi CHILD36 Sprint Sneaker (Toddler/Little Kid), green-giftz.info http://www.green-glitz.info/shoes/tsukihoshi-child36-sprint-sneaker-toddlerlittle-kid/ last visited Jan. 30, 2015.

(Continued)

*Primary Examiner* — Jila M Mohandesi
(74) *Attorney, Agent, or Firm* — Banner & Witcoff, Ltd.

(57) ABSTRACT

Strap type securing systems, e.g., for footwear or other foot-receiving devices, include a strap support with a slot located between its opposite ends. A slot reinforcement may be provided, e.g., adjacent at least some portions of the slot edge, corners, and/or ends, to prevent the strap support from tearing and/or to provide a stable base for receiving strap tensioning force. A strap includes a first portion that extends along an interior surface of the strap support, a second portion that extends through the slot and around the slot reinforcement, and a third portion that extends beyond the slot reinforcement and toward a free end of the strap. The slot and the strap may be structured and oriented such that when the third strap portion is in an unfolded or untwisted condition, a portion of the strap support is sandwiched between the first and third strap portions.

23 Claims, 10 Drawing Sheets

(56) References Cited

U.S. PATENT DOCUMENTS

| | | | | |
|---|---|---|---|---|
| 4,411,077 | A | 10/1983 | Slavitt | |
| D274,291 | S | 6/1984 | Migdow | |
| 4,476,639 | A | 10/1984 | Zaccaria | |
| D281,734 | S | 12/1985 | Gamm | |
| RE32,585 | E | 2/1988 | Antonious | |
| 4,922,630 | A | 5/1990 | Robinson | |
| 5,117,568 | A | 6/1992 | Mitsui | |
| 5,369,078 | A * | 11/1994 | Eguchi | B41M 5/3858 428/913 |
| 5,379,529 | A * | 1/1995 | Smith | A43B 5/00 36/50.1 |
| 5,771,608 | A | 6/1998 | Peterson | |
| 5,819,439 | A | 10/1998 | Sanchez | |
| 6,324,773 | B1 * | 12/2001 | Gaither | A43C 1/00 36/50.1 |
| 6,772,541 | B1 * | 8/2004 | Ritter | A43B 7/14 36/50.1 |
| 7,131,219 | B2 * | 11/2006 | Chen | A43B 7/20 36/50.1 |
| 7,171,766 | B2 | 2/2007 | Bouche et al. | |
| 7,334,354 | B2 | 2/2008 | Foxen et al. | |
| 7,437,837 | B2 | 10/2008 | Jacobs | |
| 7,490,417 | B2 * | 2/2009 | Petrie | A43C 11/008 36/170 |
| 8,006,410 | B2 | 8/2011 | Romboli et al. | |
| 8,141,274 | B2 | 3/2012 | Matsueda et al. | |
| 8,230,617 | B2 | 7/2012 | Luedecke et al. | |
| 8,302,329 | B2 * | 11/2012 | Hurd | A43B 7/20 36/68 |
| 8,321,984 | B2 | 12/2012 | Dojan et al. | |
| 8,429,835 | B2 | 4/2013 | Dojan et al. | |
| 8,516,721 | B2 | 8/2013 | Mahoney | |
| 2004/0134100 | A1 * | 7/2004 | McVicker | A43B 1/0081 36/50.1 |
| 2005/0217145 | A1 * | 10/2005 | Miyauchi | A43B 13/181 36/30 R |
| 2013/0104423 | A1 | 5/2013 | Hatfield et al. | |
| 2013/0318827 | A1 | 12/2013 | Ringholz | |
| 2014/0196317 | A1 | 7/2014 | Katz et al. | |

FOREIGN PATENT DOCUMENTS

| | | | |
|---|---|---|---|
| EP | 2494880 | A1 | 9/2012 |
| FR | 2638338 | A1 | 5/1990 |
| WO | 2004057992 | A1 | 7/2004 |

OTHER PUBLICATIONS

"Reebok-Shoe-Men-Royal-Reeamaze-Fashion-Ankle-Strap-Basketball-Tennis-Shoe-J95640" http://www.ebay.com/itm/REEBOK-Shoe-Men-Royal-Reeamaze-Fashion-Ankle-Strap-Basketball-Tennis-Shoe-J95640-/300939888860, last visited on Jan. 30, 2015.

"Ewing 33 Hi "Burgundy Sued"," Ubiq Walnat St., ubiglife.com, http://ubiqlife.com/journal/index.php/portfolio/ewing-33-hi-burgundy-suede/, May 13, 2014, last visited on Jan. 30, 2015.

* cited by examiner

STRAP SECURING SYSTEM, E.G., FOR ARTICLES OF FOOTWEAR AND OTHER FOOT-RECEIVING DEVICES

FIELD OF THE INVENTION

The present invention relates to securing systems, e.g., for use in the field of footwear and other foot-receiving devices. More specifically, aspects of the present invention pertain to strap type securing systems, e.g., for articles of footwear and other foot-receiving devices. Additional aspects of this invention relate to athletic footwear and methods of making it.

BACKGROUND

Conventional articles of athletic footwear include two primary elements, an upper and a sole structure. The upper provides a covering for the foot that securely receives and positions the foot with respect to the sole structure. In addition, the upper may have a configuration that protects the foot and provides ventilation, thereby cooling the foot and removing perspiration. The sole structure is secured to a lower surface of the upper and generally is positioned between the foot and any contact surface. In addition to attenuating ground reaction forces and absorbing energy, the sole structure may provide traction and control potentially harmful foot motion, such as over pronation. Some general features and configurations of the upper and the sole structure are discussed in greater detail below.

The upper forms a void on the interior of the footwear for receiving the foot. The void has the general shape of the foot, and access to the void is provided at an ankle or foot-insertion opening. Accordingly, the upper extends over the instep and toe areas of the foot, along the medial and lateral sides of the foot, and around the heel area of the foot. A lacing system often is incorporated into the upper to selectively change the size of the ankle opening and to permit the wearer to modify certain dimensions of the upper, particularly girth, to accommodate feet with varying proportions. In addition, the upper may include a tongue that extends under the lacing system to enhance the comfort of the footwear (e.g., to modulate pressure applied to the foot by the laces), and the upper also may include a heel counter to support, limit movement, or control movement of the heel.

The sole structure generally incorporates multiple layers that are conventionally referred to as an insole, a midsole, and an outsole. The insole (which also may constitute a sock liner) is a thin member located within the upper and adjacent the plantar (lower) surface of the foot to enhance footwear comfort, e.g., to wick away moisture. The midsole, which is traditionally attached to the upper along the entire length of the upper, forms the middle layer of the sole structure and serves a variety of purposes that include controlling foot motions and attenuating impact forces. The outsole forms the ground-contacting element of footwear and is usually fashioned from a durable, wear-resistant material that includes texturing or other features to improve traction.

The primary element of a conventional midsole is a resilient, polymer foam material, such as polyurethane or ethylvinylacetate ("EVA"), that extends throughout the length of the footwear. The properties of the polymer foam material in the midsole are primarily dependent upon factors that include the dimensional configuration of the midsole and the specific characteristics of the material selected for the polymer foam, including the density of the polymer foam material. By varying these factors throughout the midsole, the relative stiffness, degree of ground reaction force attenuation, and energy absorption properties may be altered to meet the specific demands of the activity for which the footwear is intended to be used.

Terminology/General Information

First, some general terminology and information is provided that will assist in understanding various portions of this specification and the invention(s) as described herein. As noted above, at least some aspects of the present invention relate to the field of footwear and other foot-receiving devices, including securing systems for such devices. "Foot-receiving device" means any device into which a user places at least some portion of his or her foot. In addition to all types of footwear (described below), foot-receiving devices include, but are not limited to: bindings and other devices for securing feet in snow skis, cross country skis, water skis, snowboards, and the like; bindings, clips, or other devices for securing feet in pedals for use with bicycles, exercise equipment, and the like; bindings, clips, or other devices for receiving feet during play of video games or other games; and the like. "Foot-receiving devices" may include one or more "foot-covering members" (e.g., akin in function to footwear upper components, which help position the foot with respect to other components or structures) and one or more "foot-supporting members" (e.g., akin in function to footwear sole structure components, which support at least some portion of a plantar surface of a user's foot). "Securing systems," like those in accordance with at least some aspects of this invention, may help position and/or securely hold the user's foot in place with respect to the foot-covering member(s) and/or the foot-supporting member(s). "Footwear" means any type of wearing apparel for the feet, and this term includes, but is not limited to: all types of shoes, boots, sneakers, sandals, thongs, flip-flops, mules, scuffs, slippers, sport-specific shoes (such as cricket shoes, golf shoes, tennis shoes, baseball cleats, soccer or football cleats, ski boots, basketball shoes, cross training shoes, etc.), and the like. "Foot-supporting members" may include components for and/or functioning as midsoles and/or outsoles for articles of footwear (or members providing corresponding functions in non-footwear type foot-receiving devices).

FIG. 1 also provides information that may be useful for explaining and understanding the specification and/or at least some aspects of this invention. More specifically, FIG. 1 provides a representation of a footwear/foot-receiving device component 100, which in this illustrated example constitutes a portion of a sole structure for an article of footwear. The same general definitions and terminology may apply to footwear and foot-receiving devices in general and/or to other footwear/foot-receiving device components or portions thereof, such as an upper, a midsole component, etc.

First, as illustrated in FIG. 1, the terms "forward" or "forward direction" as used herein, unless otherwise noted or clear from the context, mean toward or in a direction toward a toe area of the footwear or foot-receiving device structure or component 100. The terms "rearward" or "rearward direction" as used herein, unless otherwise noted or clear from the context, mean toward or in a direction toward a heel area of the footwear or foot-receiving device structure or component 100. The terms "lateral" or "lateral side" as used herein, unless otherwise noted or clear from the context, mean the outside or "little toe" side of the footwear or foot-receiving device structure or component 100. The terms "medial" or "medial side" as used herein, unless otherwise noted or clear from the context, mean the inside or "big toe" side of the footwear or foot-receiving device structure or component 100.

Also, various example features and aspects of this invention are disclosed or explained herein with reference to a "longitudinal direction" and/or with respect to a "longitudinal length" of a footwear/foot-receiving device component 100 (such as a footwear upper component or sole structure). As shown in FIG. 1, the "longitudinal direction" is determined as the direction of line extending from a rearmost heel location (RH in FIG. 1) to the forwardmost toe location (FT in FIG. 1) of the footwear component 100 in question. The "longitudinal length" L is the length dimension measured from the rearmost heel location RH to the forwardmost toe location FT. The rearmost heel location RH and the forwardmost toe location FT may be located by determining the rear heel and forward toe tangent points with respect to front and back parallel vertical planes VP when the component 100 (e.g., sole structure or foot-supporting member in this illustrated example, optionally as part of an article of footwear or foot-receiving device) is oriented on a horizontal support surface S in an unloaded condition (e.g., with no weight or other external force applied to it other than potentially the weight of the shoe/foot-receiving device components with which it is engaged). If the forwardmost and/or rearmost locations of a specific footwear or foot-receiving device component 100 constitute a line segment (rather than a tangent point), then the forwardmost toe location and/or the rearmost heel location constitute the mid-point of the corresponding line segment. If the forwardmost and/or rearmost locations of a specific footwear or foot-receiving device component 100 constitute two or more separated points or line segments, then the forwardmost toe location and/or the rearmost heel location constitute the mid-point of a line segment connecting the furthest spaced and separated points and/or furthest spaced and separated end points of the line segments (irrespective of whether the midpoint itself lies on the component 100 structure).

Once the longitudinal direction of a component or structure 100 has been determined with the component 100 oriented on a horizontal support surface S, planes may be oriented perpendicular to this longitudinal direction (e.g., planes running into and out of the page of FIG. 1). The locations of these perpendicular planes may be specified based on their position along the longitudinal length L where the perpendicular plane intersects the longitudinal direction between the rearmost heel location RH and the forwardmost toe location FT. In this illustrated example of FIG. 1, the rearmost heel location RH is considered as the origin for measurements (or the "0L position") and the forwardmost toe location FT is considered the end of the longitudinal length of this component (or the "1.0L position"). Plane position may be specified based on its location along the longitudinal length L (between 0L and 1.0L), measured forward from the rearmost heel RH location in this example. FIG. 1 further shows locations of various planes perpendicular to the longitudinal direction (and oriented in the transverse direction) and located along the longitudinal length L at positions 0.25L, 0.4L, 0.5L, 0.55L, 0.6L, and 0.8L (measured in a forward direction from the rearmost heel location RH). These planes may extend into and out of the page of the paper from the view shown in FIG. 1, and similar planes may be oriented at any other desired positions along the longitudinal length L. While these planes may be parallel to the parallel vertical planes VP used to determine the rearmost heel RH and forwardmost toe FT locations, this is not a requirement (rather, the orientation of the perpendicular planes along the longitudinal length L will depend on the orientation of the longitudinal direction, which may or may not be parallel to the surface S in the arrangement/orientation shown in FIG. 1).

SUMMARY

This Summary is provided to introduce some concepts relating to this invention in a simplified form that are further described below in the Detailed Description. This Summary is not intended to identify key features or essential features of the invention.

While useful for any desired types or styles of shoes or foot-receiving devices, aspects of this invention may be of particular interest for athletic shoes, including cricket shoes, basketball shoes, golf shoes, football shoes, etc.

Some aspects of this invention relate to securing systems, e.g., strap type securing systems for articles of footwear or other foot-receiving devices, that include: a strap support including a first end, a second end opposite the first end, a first surface, a second surface opposite the first surface, and a slot extending from the first surface to the second surface. The strap support may have a generally four-sided polygonal configuration, e.g., somewhat rectangular or trapezoidal in shape. The slot is defined in the strap support at a location between the first end and the second end, and this slot has a first edge and an opposite second edge, wherein the first edge is located closer to the first end than is the second edge. A slot reinforcement may be provided, e.g., at least adjacent some portions of the first edge of the slot (optionally including any corners or ends of the slot). A strap has a fixed end located proximate to the first end of the strap support and an opposite free end. This strap includes: (a) a first portion that extends along the first surface of the strap support, (b) a second portion that extends through the slot and around the slot reinforcement, and (c) a third portion that extends beyond the slot and/or the slot reinforcement and toward (and to) the free end of the strap. The slot and the strap may be structured and oriented such that when the third strap portion is in an unfolded or untwisted condition, it can lie adjacent the second surface of the strap support such that a portion of the strap support is located between (sandwiched between) at least some of the first and third strap portions.

Securing systems of these types may be incorporated into uppers, foot-covering members, articles of footwear, or other foot-receiving devices. When incorporated into such devices, the strap support described above may be engaged with one or more other components of the overall structure, such as with one or more footwear upper components (or other foot-covering member components) and/or with one or more footwear sole structure components (such as a midsole component, or other foot-supporting component). Securing systems of these types also may be incorporated into other products, such as closure/securing systems for articles of apparel, athletic equipment, containers, etc.

Additional aspects of this invention include uppers (or other foot-covering members) for articles of footwear (or other foot-receiving devices) that include:

(A) a first upper component part having: (a) a first end located adjacent a medial side of a foot-receiving opening and/or front instep area defined by the upper/foot-covering member, (b) a first major surface, (c) a second major surface opposite the first major surface, and (d) a slot defined in the first upper component part and extending from the first major surface to the second major surface, wherein at least a majority of the slot (and optionally all of the slot) is defined at least 0.75 inches away from the first end of the first upper component part, wherein the slot has a first edge and an opposite second edge, and wherein the first edge is located closer to the first end than is the second edge; and (B) a strap having a fixed end and a free end opposite the fixed end, wherein the fixed end of the strap is fixed proximate to the first end of the first component part (e.g., via a sewn seam), and wherein the strap includes: (a) a first portion that extends along the first major surface of the strap support (e.g., for at least 0.75 inches), (b) a second portion that extends through the slot and around the first edge of the slot, and (c) a third portion that extends beyond the slot and toward (and to) the free end of the strap.

Uppers or foot-covering members of these types further may include a slot reinforcement provided adjacent at least a portion of the first edge of the slot (e.g., at its extreme edges or corners). The slot reinforcement may take on a variety of different constructions without departing from this invention, including, for example: a D-ring; an O-ring; a plastic component with a slot through it; a coating or an infiltrate applied to the first upper component part at least at some portion(s) of the first edge and/or the corners of the slot; etc. The slot reinforcement may constitute a plastic, textile, or metal part, e.g., with a slot formed through it, that is fit and optionally fixed within the slot provided in the first upper component part (e.g., in the strap support). The slot reinforcement may be engaged with the first upper component part (e.g., the strap support) by a mechanical connection (e.g., crimped metal or a fastener), by a mechanical connector, by a seam, by an adhesive or cement, etc.

In uppers/foot-covering members of these types, the slot and the strap may be structured and oriented such that when the third strap portion is in an unfolded or untwisted condition, it can lie adjacent the second major surface of the strap support such that a portion of the first upper component part is located between (sandwiched between) at least some of the first and third strap portions. Furthermore, in such uppers/foot-covering members, the third portion of the strap, at a location closer to the free end than the fixed end, may include a first portion of a fastening device (e.g., one or more hook-and-loop type fasteners, one or more snaps, one or more buttons, one or more buckles, etc.). This fastening device portion may engage a complementary portion of the fastening device, e.g., located on a component of the upper/foot-covering member and/or some other portion of the footwear/foot-receiving device structure. The portions of the fastening device may be releasably engagable with one another, e.g., to releasably secure the upper/foot-covering member and/or footwear/foot-receiving device with a wearer's foot.

The first upper component part (e.g., the strap support) described above may constitute a rectangular or trapezoidal strap type structure that extends along the medial heel area of the upper/foot-covering member (e.g., from the foot-receiving opening and/or the top, front instep area to the bottom and/or sole structure/foot-supporting area of the device, optionally extending in a rearward, downward slanted direction). Additionally or alternatively, if desired, uppers/foot-covering components in accordance with at least some examples of this invention may include a similar rectangular or trapezoidal strap type structure as a lateral heel component that extends along the lateral heel area of the upper/foot-covering member (optionally extending from the foot-receiving opening and/or the top, front instep area to the bottom and/or sole structure/foot-supporting area of the device, optionally extending in a rearward, downward slanted direction). Some examples of this lateral heel component may include: a first end located adjacent a lateral side of the foot-receiving opening and/or top, front instep area; a second end located proximate a bottom, lateral heel area; a first edge extending between the first end and the second end of the lateral heel component and located along a lateral heel area; and a second edge extending between the first end and the second end and located along the lateral heel area (wherein the first edge of the lateral heel component is located closer to the rear heel area of the upper than is the second edge of the lateral heel component). The lateral heel component may be of the same general size, shape, and orientation as the medial heel component (but on the opposite side of the heel).

Still further example uppers/foot-covering members according to at least some examples of this invention may include:

(A) a plurality of upper component parts that define at least a portion of a foot-receiving chamber and include at least: (a) a first upper component part extending at least along a medial midfoot area of the upper, (b) a strap support engaged with the first upper component part and including: (i) a first end located adjacent a medial side of a foot-receiving opening defined by the upper, (ii) a second end located proximate a bottom, medial heel area of the upper, (iii) a first edge extending between the first end and the second end and located along a medial heel area of the upper, and (iv) a second edge extending between the first end and the second end and located along the medial heel area of the upper, wherein the second edge is located closer to a toe area of the upper than is the first edge;

(B) a strap tensioning element engaged with the strap support between the first end and the second end; and (C) a strap having a fixed end and a free end opposite the fixed end, wherein the fixed end of the strap is fixed proximate to the first end of the strap support, wherein the strap includes a first portion that extends from the fixed end to the strap tensioning element, a second portion that extends around the strap tensioning element, and a third portion located beyond the strap tensioning element that extends toward (and to) the free end of the strap, and wherein the strap wraps around the strap tensioning element such that when the third portion of the strap is in an unfolded or untwisted condition, at least some of the third portion of the strap can overlap (and overlie) the first portion of the strap.

The strap tensioning element may constitute a ring, a partial ring, or a slotted member around which the second portion of the strap wraps.

In at least some examples, this upper/foot-covering member need not include a portion of the strap support sandwiched between portions of the strap when the strap is engaged (e.g., pulled tight around a foot). Rather, if desired, the strap tensioning element may be mounted to an exterior surface of the upper/foot-covering member and the strap may remain at the exterior of the upper/foot-covering member. Alternatively, the strap tensioning element described above may constitute a slot formed in the strap support and/or a slot reinforcement formed in the strap support (e.g., so that a portion of the strap may be located between the strap support and an underlying layer of the upper).

Additional aspects of this invention relate to articles of footwear (or other foot-receiving devices) that include upper members (or other foot-covering members) and/or securing systems of the various types described above. Such articles of footwear (or other foot-receiving devices) may include a sole structure (or other foot-supporting members) engaged with the upper (or other foot-covering member), e.g., in any desired manner, including in conventional manners as are known and used in the footwear art. The sole structures may include cleats, spikes, and/or other types of traction-enhancing element, including fraction elements for specific sports or other activities, such as cricket.

Additional aspects of this invention relate to methods of making articles of footwear and/or other foot-receiving devices that include engaging the various parts described above together, e.g., using mechanical connectors; using cements or adhesives (including hot melt adhesive materials); using sewing or stitching; etc.

BRIEF DESCRIPTION OF THE DRAWINGS

The foregoing Summary, as well as the following Detailed Description, will be better understood when read in conjunction with the accompanying drawings in which like reference numerals refer to the same or similar elements in all of the various views in which that reference number appears.

Figure 1:
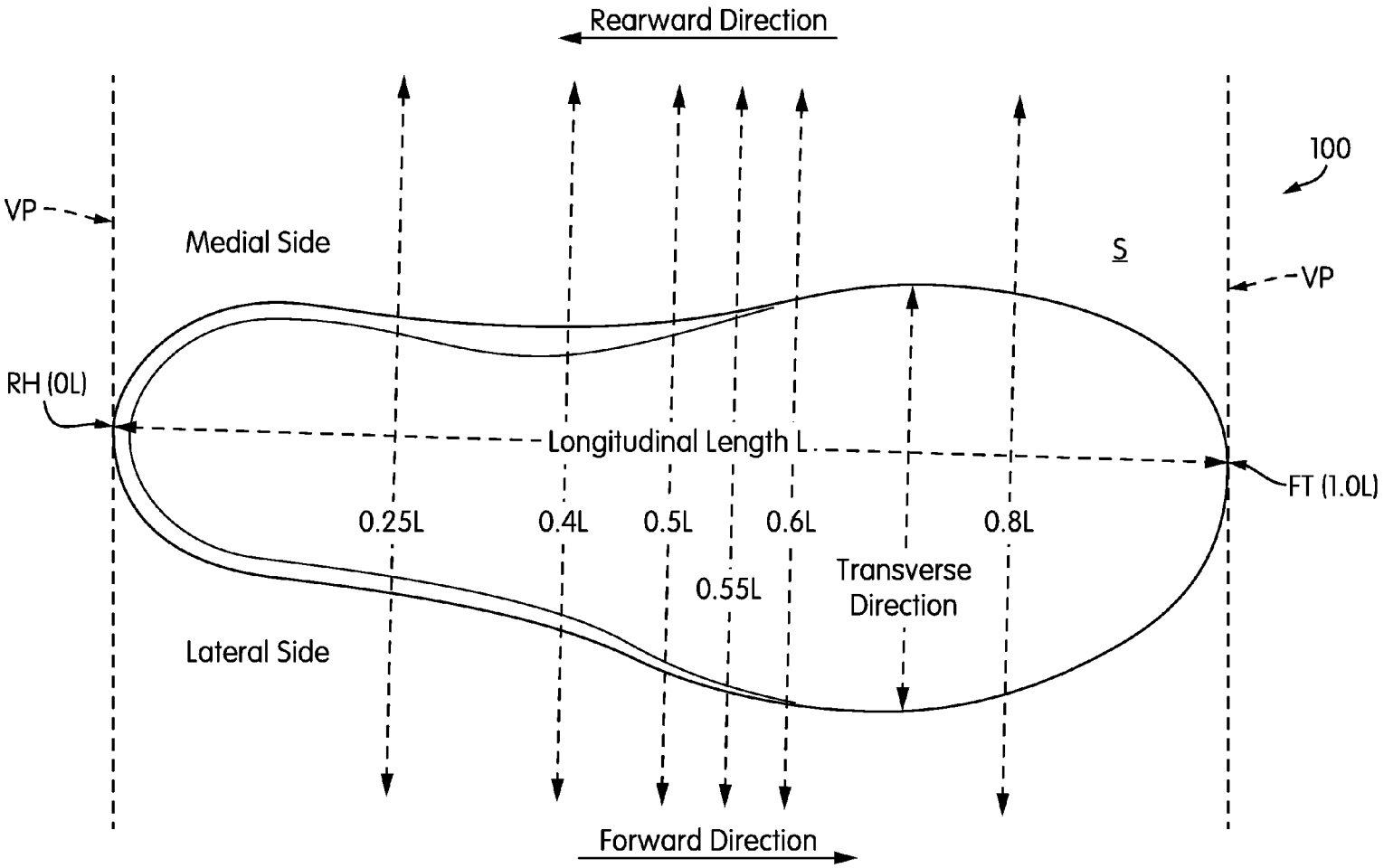
FIG. 1 is provided to help illustrate and explain background and definitional information useful for understanding certain terminology used in this specification and some aspects of this invention.

The reader should understand that the attached drawings are not necessarily drawn to scale.

DETAILED DESCRIPTION

In the following description of various examples of footwear and foot-receiving device structures and components according to aspects of the present invention, reference is made to the accompanying drawings, which form a part hereof, and in which are shown by way of illustration various example structures and environments in which aspects of the invention may be practiced. It is to be understood that other structures and environments may be utilized and that structural and functional modifications may be made from the specifically described structures without departing from the scope of the present invention.

I. Detailed Description of Example Articles of Footwear or Other Foot-Receiving Devices According to this Invention Referring to the figures and following discussion, various articles of footwear and features thereof in accordance with the present invention are disclosed. The footwear depicted and discussed are athletic shoes (e.g., cricket shoes), but the concepts disclosed with respect to this footwear may be applied to a wide range of athletic footwear styles, including, but not limited to: walking shoes, tennis shoes, golf shoes, soccer shoes, football shoes, basketball shoes, running shoes, and cross-training shoes. In addition, aspects of the present invention may be applied to a wide range of non-athletic footwear, including work boots, sandals, loafers, and dress shoes, as well as to other foot-receiving devices.

FIGS. 2A-2D show various views of an article of footwear 200 in accordance with one example of this invention in the form of a cricket shoe. The article of footwear 200 includes an upper 202 and a sole structure 204 engaged with the upper 202. While this engagement may be made in any desired manner, including in manners conventionally known and used in the footwear art, in this illustrated example, the upper 202 and the sole structure 204 are engaged by cements or adhesives, e.g., applied between the top surface of the midsole member 204*a* and the bottom surface of a strobel member 222. The upper 202 (optionally along with the sole structure 204 and/or strobel member 222) defines an interior chamber 206 for receiving a wearer's foot. Access to this chamber 206 may be made through a foot-insertion opening 208 provided at the top, rearward area of the upper 202 and/or along the top, front instep area of the upper 202.

The upper 202 may have any desired construction and/or may be made from any desired number of parts and/or materials without departing from this invention. In some examples of this invention, the upper 202 will have a multiple layer construction, with various layers and/or combinations of layers at various locations so as to provide desired functions and/or characteristics, such breathability, abrasion/wear resistance, support for intended use, etc.; desired aesthetics; etc. Similarly, the sole structure 204 may have any desired construction and/or may be made from any desired number of parts and/or materials without departing from this invention. In some examples of this invention, the sole structure 204 will have a multiple layer construction, with various layers and/or combinations of layers at various locations so as to provide desired functions (e.g., flexibility, support, gait control, breathability, fraction, etc.). The illustrated example shows that the sole structure 204 includes midsole component 204*a* (e.g., made from a polymeric foam material) and an outsole component 204*b* (e.g., made from a rubber or thermoplastic polyurethane material). In this example, outsole component 204*b* covers an entire bottom surface of the shoe and, at least at some locations, wraps around the side surfaces of the midsole 204*a* and partially cups or contains the midsole 204*a*. Other sole structure options are possible without departing from this invention.

When present as a multi-layered upper construction, the upper 202 may be produced in any desired manner without departing from this invention, including in conventional manners as are known and used in the footwear art. As some more specific examples, if desired, the upper 202 may include one or more "skin" layers 212 (e.g., a thin, thermoplastic sheet or membrane layer, such as a TPU, that provides abrasion resistance, support, desired aesthetics, etc.) made from a "no-sew" type material that may be adhered to an underlying mesh layer 214 (or other upper layer) using an adhesive or hot melt material, e.g., by application of heat and/or pressure. The mesh layer 214 provides a lightweight base and may be left exposed in certain areas, if desired, e.g., to enhance breathability and/or flexibility at desired areas. As additional examples, if desired, the skin layer(s) 212 may be engaged with the underlying mesh layer 214 (or other upper layer) by other types of cements or adhesives and/or by sewn seams. As yet additional examples, if desired, the upper 202 (or portions thereof) may be constructed by bonding various layers of materials using fusing techniques, e.g., as described in U.S. Pat. No. 8,429,835 and U.S. Pat. No. 8,321,984, each of which is entirely incorporated herein by reference.

Figure 2A:
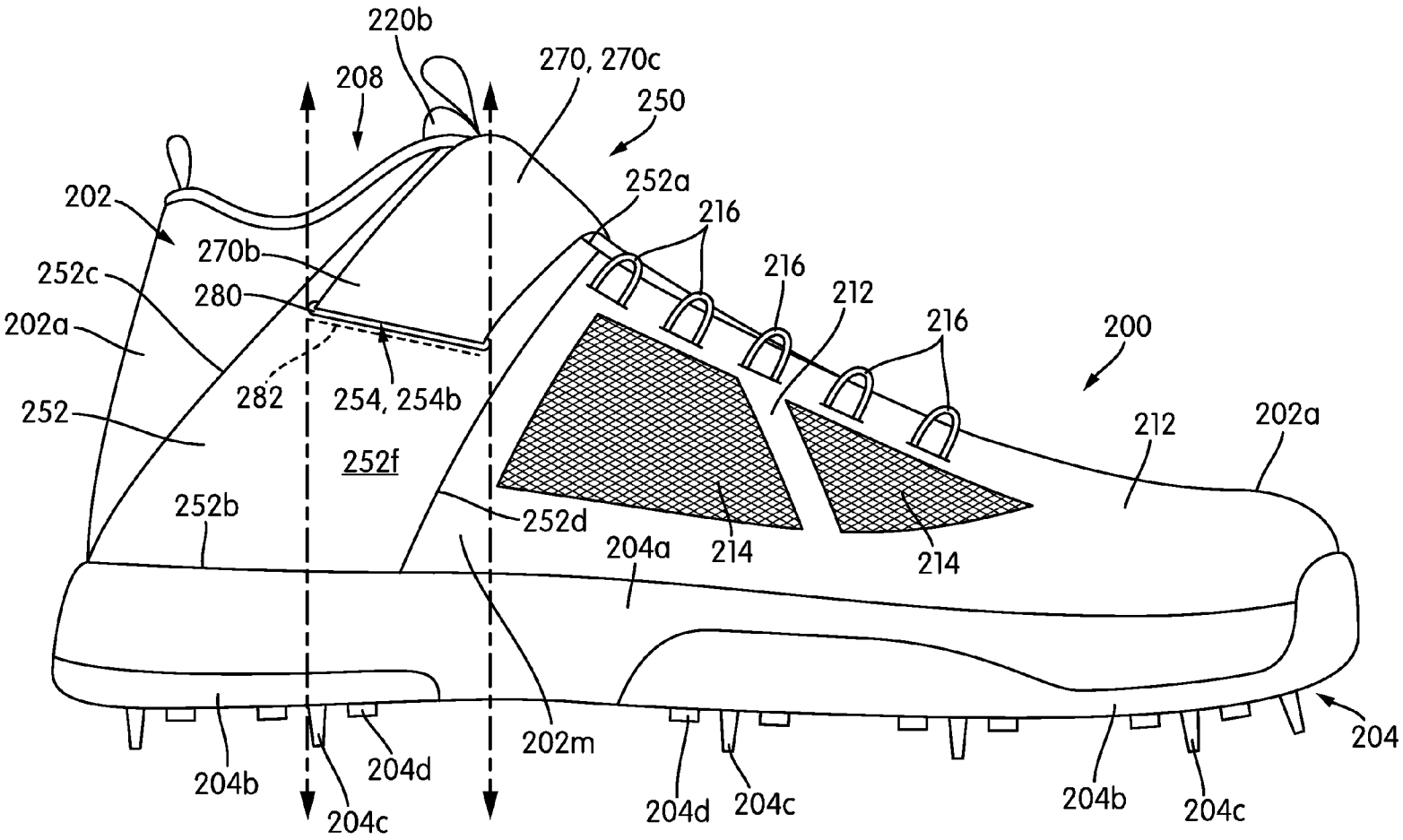
FIG. 2A provides a medial side view of an example article of footwear in accordance with some aspects of this invention.
Figure 2B:
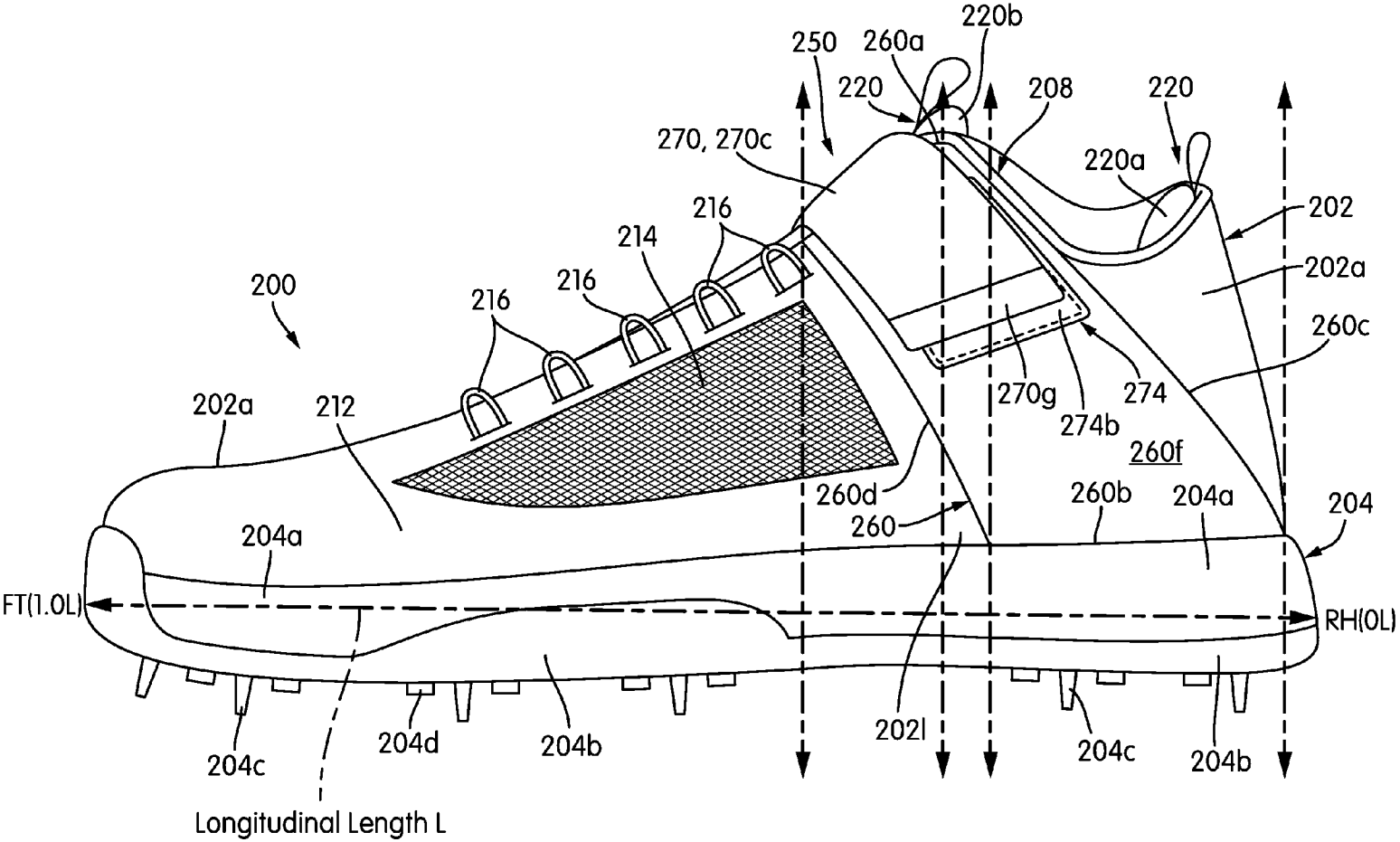
FIG. 2B provides a lateral side view of the example article of footwear shown in FIG. 2A.
Figure 2C:
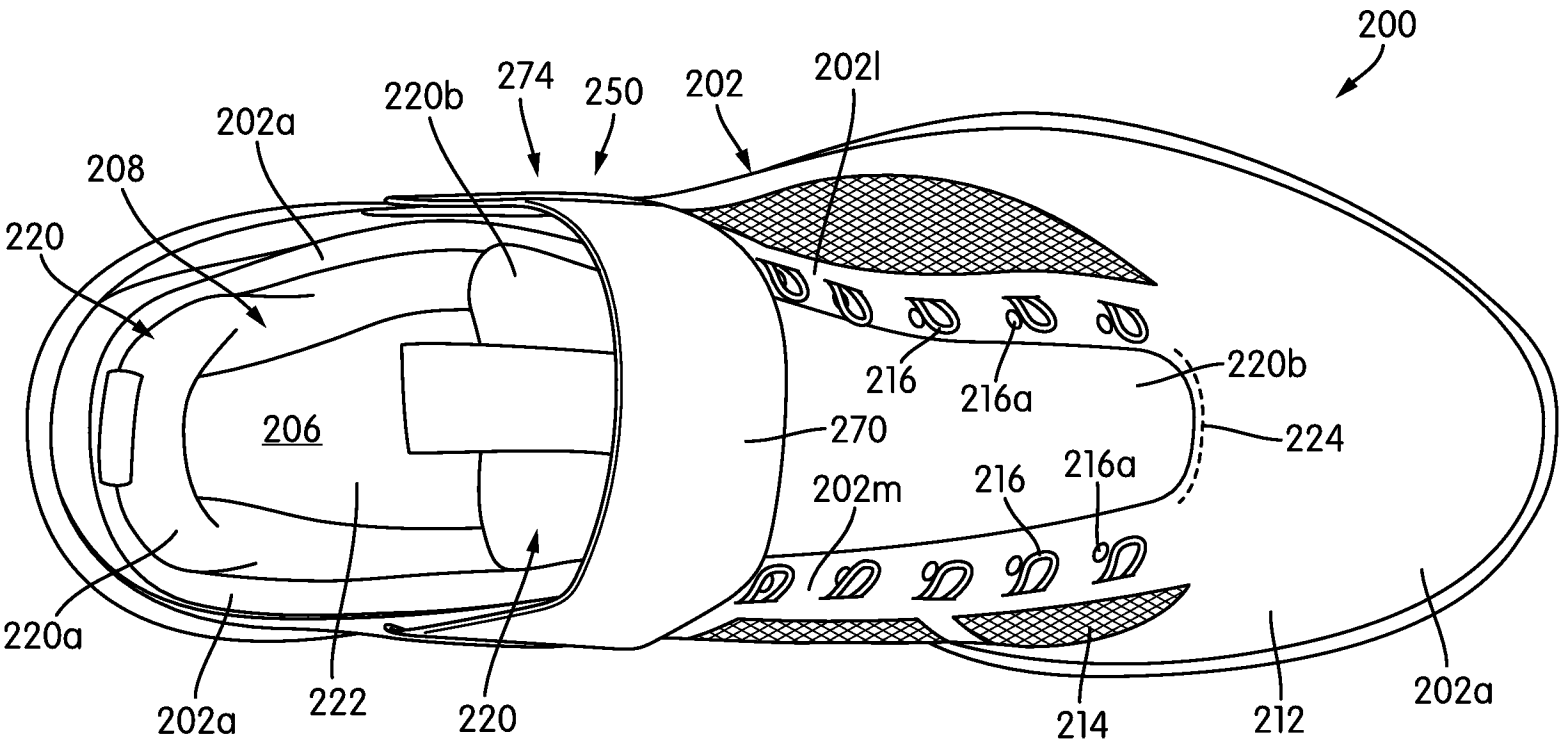
FIG. 2C provides a top view of the example article of footwear shown in FIG. 2A.

As still additional examples, uppers 202 in accordance with at least some examples of this invention may include foot securing and engaging structures (e.g., "dynamic" and/or "adaptive fit" structures) of the types described in U.S. Patent Appln. Publication No. 2013/0104423, which publication is entirely incorporated herein by reference. Examples of these features are illustrated in FIGS. 2A-2C as the lace engaging elements 216 formed as loops of wire, fiber, thread, or other strand-like structures that at least partially wrap around the sides (and optionally around the bottom) of the upper 202 (e.g., extending between components of the upper 202 and midsole 204*a*, between the midsole 204*a* and outsole 204*b*, etc.). The illustrated shoe 200 of this example includes both loop/strand type dynamic or adaptive fit lace engaging elements 216 and conventional lace engaging openings 216*a* defined in the upper 202.

The upper 202 may include other support elements at desired locations, optionally sandwiched between an exterior skin layer 212 and the underlying mesh layer 214, between other layers of the upper 202, inside the upper 202, or attached to the upper 202 exterior surface. For example, a heel counter (e.g., to support a wearer's heel) may be provided as an interior or sandwiched component in this example footwear structure 200. The heel counter, when present, may be made from a rigid, plastic material, such as PEBAX, TPU, fiber reinforced plastics (e.g., carbon fiber or fiberglass), or other polymeric material. As additional options, the heel counter may include one or more openings (e.g., to control flexibility, breathability, support characteristics, etc.; to reduce weight; etc.). The heel counter also may be made from a heavy and/or thick textile material (e.g., leather), if desired. Additionally or alternatively, a heel counter and/or other supports may be provided as exterior upper structures as well.

Other potential materials that may be used in uppers 202 in accordance with at least some examples of this invention include one or more of: synthetic leather, natural leather, textiles, fabrics, thermoplastic polyurethanes, other polymers, any combination of these materials, and/or any combinations of these materials with any of the other materials described above. As another potential feature, if desired, at least some portion(s) of the upper 202 may be formed by a knitting procedure, such as flat knitting, circular knitting, etc. Optionally, at least a majority (or even all) of the upper 202 may be formed using knitting procedures, in at least some examples of this invention. Knitted textile components can be used to provide lightweight, breathable, and comfortable upper constructions.

Figure 2D:
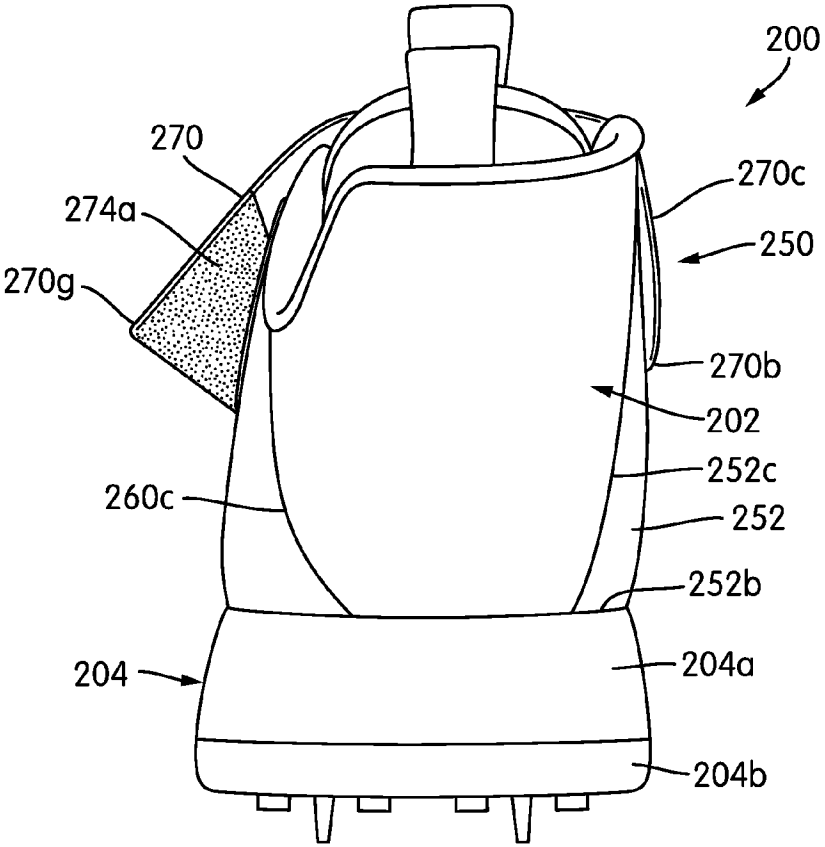
FIG. 2D provides a rear view of the example article of footwear shown in FIG. 2A.

As noted above, the sole structure 204 also can take on any desired construction, components, and the like without departing from this invention. In the illustrated example, the sole structure 204 includes a single piece outsole 204*b* that extends continuously to support an entire plantar surface of a wearer's foot, and this outsole 204*b* has plural cleats or spikes 204*c* (primary traction components) engaged with it (permanently fixed and/or removable/replaceable (and releasably attached via a mechanical connection, such as a turnbuckle or threaded connector or structure)). Secondary traction components 204*d* (e.g., raised nubs, molded in cleats or nubs, etc.) also may be provided in the outsole 204*b*. As noted above, portions of the outsole 204*b* wrap up around the sides of the footwear structure 200 (e.g., around the midsole 204*a* side surfaces) at some locations, e.g., to provide additional support, wear resistance, and/or other properties at those locations. More specifically, as shown in FIGS. 2A, 2B, and 2D, the outsole 204*b* of this example wraps upward and around the side of the shoe 200 (around a portion of the side surfaces of midsole component 204*a*) in the forward toe area, at the lateral midfoot/forefoot area, at the lateral heel side area, around the entire rear heel area (or, optionally, around one or more separated portions of the rear heel area), at the lateral heel/midfoot area, and at the lateral midfoot/forefoot area. The outsole 204*b* also could be made of two or more separate parts, if desired.

Also, while the foam midsole 204*a* and TPU or rubber outsole 204*b* are the only sole structures visible in this example shoe 200 construction, the shoe 200 may include other and/or different sole components, as well, such as other and/or different outsole, midsole, and/or insole components. As some more specific examples, sole structures 204 that may be used in examples of this invention may include one or more of: one or more impact-force attenuating columns (akin to SHOX type footwear products available from NIKE, Inc. of Beaverton, Oreg.); one or more fluid-filled bladders (akin to AIR type footwear products available from NIKE, Inc. of Beaverton, Oreg.); one or more lugs and/or sipes (e.g., to provide more natural motion, akin to sole structures used in FREE type footwear products available from NIKE, Inc. of Beaverton, Oreg.); mechanical shock absorbing structures; etc.

FIGS. 2A-2C further illustrate that the upper 202 of this example article of footwear 200 includes a partial interior bootie component 220. This example interior bootie component 220, along with a strobel member 222 sewn to its bottom edge, defines at least a majority of the actual interior chamber 206 for receiving the wearer's foot. The bootie component 220 includes a heel containment portion 220*a* and a footwear "tongue" element 220*b* (over the instep area), and this bootie component 220 extends from the rear heel to the forefoot toe area of the foot-containing chamber 206. The bootie component 220 is engaged at some locations with an outer upper shell layer 202*a* that includes the skin layers 212, mesh layer 214, and the like described above. This engagement may be by sewn seams, mechanical connectors, cements or adhesives, etc., and may be provided only at select locations around the upper construction (e.g., at the bottom, at the rear heel, at the instep area (e.g., see sewn seam 224 in FIG. 2C), etc. In this illustrated example, the strands 216 forming the adaptive or dynamic fit lace-engaging components extend in an open volume or an unattached area between interior bootie component 220 and the outer shell layer 202*a* of the upper 202 at the midfoot to forefoot area of the upper 202 construction. The interior bootie member 220 of this example may be a relatively soft foam and/or fabric type component that helps moderate the feel of the footwear securing system at the wearer's foot and/or otherwise provides a soft, comfortable feel.

In addition to the lacing system described above (e.g., with dynamic fit lace engaging strands 216 and lace openings 216*a*), the shoe 200 in accordance with at least some examples of this invention includes an additional strap-type securing system 250. Various features of strap-type securing systems 250 in accordance with some aspects of this invention now will be described in more detail with reference to FIGS. 2A through 2L.

FIGS. 2A-2E illustrate that this example upper 202 includes a plurality of upper component parts engaged together (e.g., by stitching or sewing, by adhesives or cements (e.g., including fuse bonded or hot melt bonded components), etc.) to define at least a portion of the foot-receiving chamber 206. While any desired number of parts or components may be provided in the upper 202 (some examples of which are described above), this illustrated example upper 202 includes one upper component part 202*m* extending at least along a medial midfoot area of the upper 202 (see FIGS. 2A, 2C, and 2E). A medial side strap support 252 (which may be considered part of the strap securing system 250 and/or an upper component part) is engaged at least with the upper component part 202*m* (e.g., by stitching or other seams, by an adhesive, by a mechanical connector, etc.). In this illustrated example, the medial side strap support 252 includes a first (top) end 252*a* (located adjacent the foot-receiving opening 208 and/or at a top, front instep area), a second (bottom) end 252*b* opposite the first end 252*a*, a first (rear) side edge 252*c* that extends between the top end 252*a* and the bottom end 252*b*, a second (front) side edge 252*d* that extends between the top end 252*a* and the bottom end 252*b*, a first (interior) surface 252*e*, and a second (exterior) surface 252*f* opposite the first surface 252*e*. In this manner (but while other constructions, shapes, sizes, etc., are possible), the medial side strap support 252 has a generally rectangular or trapezoidal shape, and it extends in a direction from the top or front instep area of the foot-receiving opening 208 to the location where the upper 202 meets the sole structure 204. In this illustrated example, the medial side strap support 252 extends this complete distance and is secured between the top (interior) surface of the midsole component 204*a* and a bottom surface of the strobel member 222 by an adhesive or cement bond. Thus, the medial side strap support 252 forms a band-like structure that extends along the medial ankle and medial heel area of the upper 202 in a downward and rearward slanted direction.

As further shown in the figures, the medial side strap support 252 of this example includes a slot 254 extending from its interior surface 252*e* to its exterior surface 252*f*. In this illustrated example, the slot 254 is defined in the strap support 252 at a location between the first end 252*a* and the second end 252*b* and generally extends in a direction between the rear edge 252*c* and the front edge 252*d*. The ends of the slot 254 may stop somewhat short of the rear edge 252*c* and the front edge 252*d* (e.g., within 0.1 to 0.5 inches from the edges 252*c*/252*d*). The slot 254 of this example has a first (top) edge 254*a* and an opposite second (bottom) edge 254*b*, and these edges 254*a*/254*b* may be separated from one another (in an unstressed or unloaded condition) by a distance of less than 0.5 inches, and in some examples, by a distance of less than 0.25 inches, or even less than 0.1 inches over a majority (or even over all) of the slot's length.

The slot 254 may be located at any desired location in the strap support 252. As some more specific examples, in at least some structures in accordance with this invention, the slot 254 may be sized, shaped, and defined through the major surfaces 252*e* to 252*f* of the strap support 252 at a location such that at least a majority of the slot 254 (and optionally at least 75%, at least 90%, at least 95%, or even 100% of the slot 254) is defined at least 0.5 inches (and in some examples, at least 0.75 inches or even at least 1 inch) away from the upper (first) end 252*a* of the strap support 252. The slot 254 also may be located closer to the upper end 252*a* than the lower end 252*b* of the strap support 252.

In at least some examples of this invention, in the completed shoe structure, the upper component part that forms the entire strap support 252 may be located along the longitudinal length L of the shoe 200 at a location rearward of a plane perpendicular to the longitudinal direction and oriented at 0.6L, and in some examples, rearward of perpendicular planes located at 0.55L or 0.5L (e.g., the forward most edge or point 252*i* of medial strap support 252 and/or the corner of top end 252*a* and forward edge 252*d* may be located rearward of these plane locations). As some additional potential orientation parameters, one or more of the following may apply to strap support 252:

(A) the forward-most portion of slot 254 may be located rearward of a plane perpendicular to the longitudinal direction and oriented at 0.5L (and in some examples, rearward of perpendicular planes oriented at 0.45L or 0.4L);

(B) the rearward-most portion of slot 254 may be located rearward of a plane perpendicular to the longitudinal direction and oriented at 0.35L (and in some examples, rearward of perpendicular planes oriented at 0.3L or 0.25L);

(C) the corner of top end 252*a* and rear edge 252*c* may be located rearward of a plane perpendicular to the longitudinal direction and oriented at 0.5L (and in some examples, rearward of perpendicular planes oriented at 0.45L or 0.4L);

(D) the forward edge 252*d* may meet the sole structure 204 (the midsole 204*a*, in this illustrated example) at a location rearward of a plane perpendicular to the longitudinal direction and oriented at 0.45L, and in some examples, rearward of perpendicular planes located at 0.4L or 0.35L; and/or (E) the rearward edge 252*c* may meet the sole structure 204 (the midsole 204*a*, in this illustrated example) at a location rearward of a plane perpendicular to the longitudinal direction and oriented at 0.15L, and in some examples, rearward of perpendicular planes located at 0.125L or 0.1L.

If desired, the entire strap support 252 (or at least the entire visible or exposed portion(s) of strap support 252) may be located between perpendicular planes oriented at 0L and 0.6L, and in some examples, between perpendicular planes located at 0.02L and 0.5L or even between perpendicular planes located at 0.04L and 0.45L. All of these noted plane locations are based on the longitudinal direction and longitudinal length L defined by the completed shoe structure (e.g., like shoe structure 200 shown in the figures), and as described above in conjunction with FIG. 1.

Footwear structures 200 in accordance with at least some examples of this invention may include an upper component part in the form of a lateral heel component or a lateral side strap support 260. This lateral side strap support 260 also may be considered to constitute a portion of the strap securing system 250. The lateral side strap support 260 may have a similar shape and/or orientation to the medial side strap support 252, if desired (e.g., a somewhat rectangular or trapezoidal shape that extends in a direction from (and optionally completely between) the foot-insertion opening 208 and/or the top, front instep area to the sole structure 204 at the lateral heel area of the upper 202). Also, the lateral side strap support 260 may engage other upper component parts, such as a lateral midfoot part 202*l* (which may be a portion of the same part as upper component part 202*m* or may be a separate part). More specifically, the lateral side strap support 260 may include: (a) a first (top) end 260*a* located adjacent a lateral side of the foot-receiving opening 208 defined by the upper 202 (e.g., along or at the top instep area of the foot-receiving opening 208); (b) a second (bottom) end 262*b* located proximate a bottom, lateral heel area of the upper 202 (e.g., and potentially extending along a top (interior) surface of midsole component 204*a*); (c) a first (rearward) edge 260*c* extending between the first end 260*a* and the second end 260*b* and located along a lateral heel area of the upper; and (d) a second (forward) edge 260*d* extending between the first end 260*a* and the second end 260*b* and located along the lateral heel area of the upper. Thus, the lateral side strap support 260 forms a band-like structure that extends along the lateral ankle and lateral heel area of the upper 202 in a downward and rearward slanted direction.

While other sizes, shapes, and/or orientations are possible, in this illustrated example, the upper component part that forms the lateral strap support 260 may be located along the longitudinal length L of the shoe 200 at a location rearward of a plane perpendicular to the longitudinal direction and oriented at 0.6L, and in some examples, rearward of perpendicular planes located at 0.55L or 0.5L (e.g., the forward most edge or point of lateral strap support 260 and/or the corner of top end 260*a* and forward edge 260*d* may be located rearward of these plane locations). As some additional potential orientation parameters, one or more of the following may apply to lateral strap support 260:

(A) the corner of top end 260*a* and rear edge 260*c* may be located rearward of a plane perpendicular to the longitudinal direction and oriented at 0.5L (and in some examples, rearward of perpendicular planes oriented at 0.45L or 0.4L);

(B) the forward edge 260*d* may meet the sole structure 204 (the midsole 204*a*, in this illustrated example) at a location rearward of a plane perpendicular to the longitudinal direction and oriented at 0.45L, and in some examples, rearward of perpendicular planes oriented at 0.4L or 0.35L; and/or (C) the rearward edge 260*c* may meet the sole structure 204 (the midsole 204*a*, in this illustrated example) at a location rearward of a plane perpendicular to the longitudinal direction and oriented at 0.15L, and in some examples, rearward of perpendicular planes oriented at 0.125L or 0.1L.

If desired, the entire lateral strap support 260 (or at least the entire visible or exposed portion(s) of the lateral strap support 260) may be located between perpendicular planes oriented at 0L and 0.6L, and in some examples, between perpendicular planes located at 0.02L and 0.5L or even between perpendicular planes located at 0.04L and 0.45L. All of these noted plane locations are based on the longitudinal direction and longitudinal length L defined by the completed shoe structure (e.g., like shoe structure 200 shown in the figures), and as described above in conjunction with FIG. 1.

The strap supports 252 and/or 260 may be made of any desired material (the same or different materials) without departing from this invention, including materials conventionally known and used in footwear upper constructions. As some more specific examples, the strap supports 252 and/or 260 may be made from a relatively non-stretchable material (non-stretchable under forces typically applied in fastening a shoe to a wearer's foot), such as leathers (natural or synthetic), thermoplastics polyurethanes, etc. The term "non-stretchable," as used herein in this context, means a material that stretches less than 10% of its length under an applied force in the length or force application direction.

The figures further illustrate that this example shoe 200 includes a strap 270 that helps secure the shoe 200 to a wearer's foot. In this illustrated example, the strap 270 has a fixed end 270*f* located between layers of the upper 202 (as will be explained in more detail below) and a free end 270*g* opposite the fixed end 270*f*. As shown, for example, in FIGS. 2E-2H, the fixed end 270*f* of the strap 270 may be fixed proximate to the first (top) end 252*a* of the medial strap support 252, at its interior surface 252*e*, e.g., by a sewn seam 272.

In the example shown in FIGS. 2A-2H, the strap 270 includes: (a) a first portion 270*a* (an interior strap portion in this example) that extends along the interior surface 252*e* of the medial strap support 252 and optionally is located between the medial strap support 252 and another layer of the upper 202 (such as bootie component 220), (b) a second portion 270*b* that extends through the slot 254 (and wraps around top edge 254*a* of slot 254), and (c) a third portion 270*c* that extends beyond the slot 254 and toward (and to) the free end 270*g* of the strap 270. The slot 254 and the strap 270 may be structured and oriented such that when the third strap portion 270*c* is extended and wrapped around the footwear 200 structure in an unfolded or untwisted condition, it can lie adjacent the second (exterior) surface 252*f* of the medial strap support 252 such that a portion of the strap support 252 is located between (sandwiched between) at least some of the first portion 270*a* and the third portion 270*c* of the strap 270. Note, for example, FIGS. 2A and 2H.

Figure 2E:
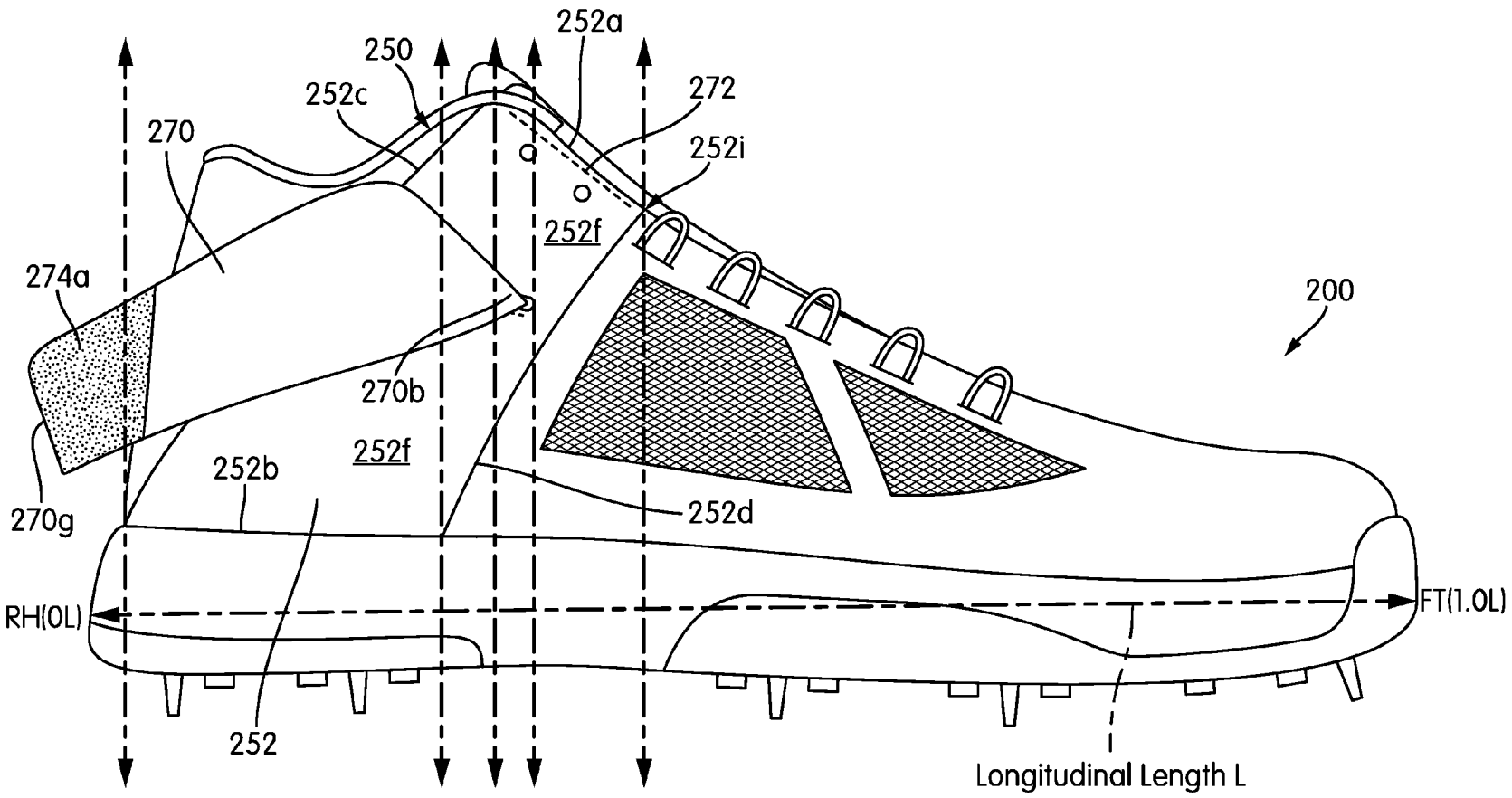
FIG. 2E provides a medial side view of the example article of footwear shown in FIG. 2A with the strap in an unengaged position.
Figure 2F:
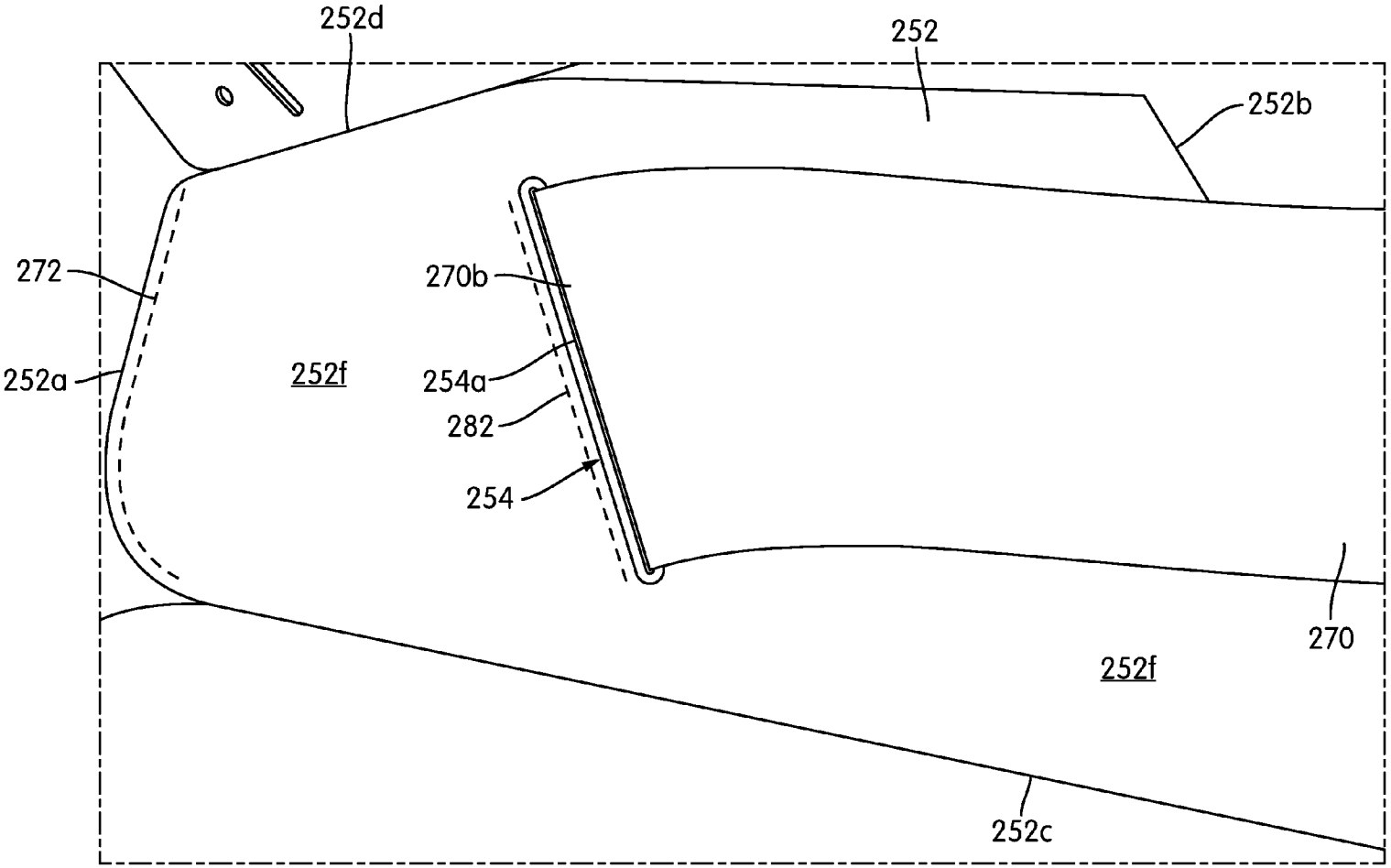
FIG. 2F provides a top or exterior view of a strap support component provided, for example, in uppers and articles of footwear in accordance with at least some aspects of this invention.

FIGS. 2A through 2E illustrate additional features of the strap securing system 250 according to this example of the invention. More specifically, as shown in FIGS. 2D and 2E, the third portion 270*c* of strap 270 includes a first portion 274*a* of a releasable fastening device 274 at a location closer to the free end 270*g* than to the fixed end 270*f* of strap 270. Additionally, the lateral heel component or strap support 260 includes a second portion 274*b* of the fastening device 274 (e.g., engaged with an outer surface 260*f* of lateral strap support 260). While any type of releasable fastening device 274 may be used without departing from this invention, in this illustrated example, the fastening device 274 is a hook-and-loop type fastening device for releasably securing the upper 202 with a wearer's foot. In use, the strap 270 can be pulled tight around the wearer's foot by applying a pulling force on the strap 270, which is translated to a force on medial heel component 252 by the second portion 270*b* of the strap 270 engaged around the top edge 254*a* of slot 254. The strap 270 can be pulled tight around the slot edge 254*a* and then fixed in place (e.g., at a lateral ankle or heel area) via engagement of the portions 274*a*, 274*b* of fastening device 274.

Other types of fastening devices 274 that may be used without departing from this invention include but are not limited to: buckle type fasteners, snap type fasteners, button type fasteners, and the like. As another example, an exterior surface of the lateral heel component 260 (or other footwear component) may be equipped with a strap tensioning device, such as a ring (e.g., an O-ring or a D-ring or the like), a partial ring, or a slotted member (e.g., like slot reinforcement 282 described in more detail below) through which the free end 270*g* of the strap 270 is fed and doubled back over itself and then fastened (e.g., using a hook and loop fastener, a buckle type fastener, a snap type fastener, a button type fastener, or the like). In this manner, the strap 270 can be pulled tight around the wearer's foot by applying a pulling force on medial heel component 252 around the slot edge 254*a* and a pulling force on the lateral heel component 260 via the additional tensioning member described above.

Figure 2G:
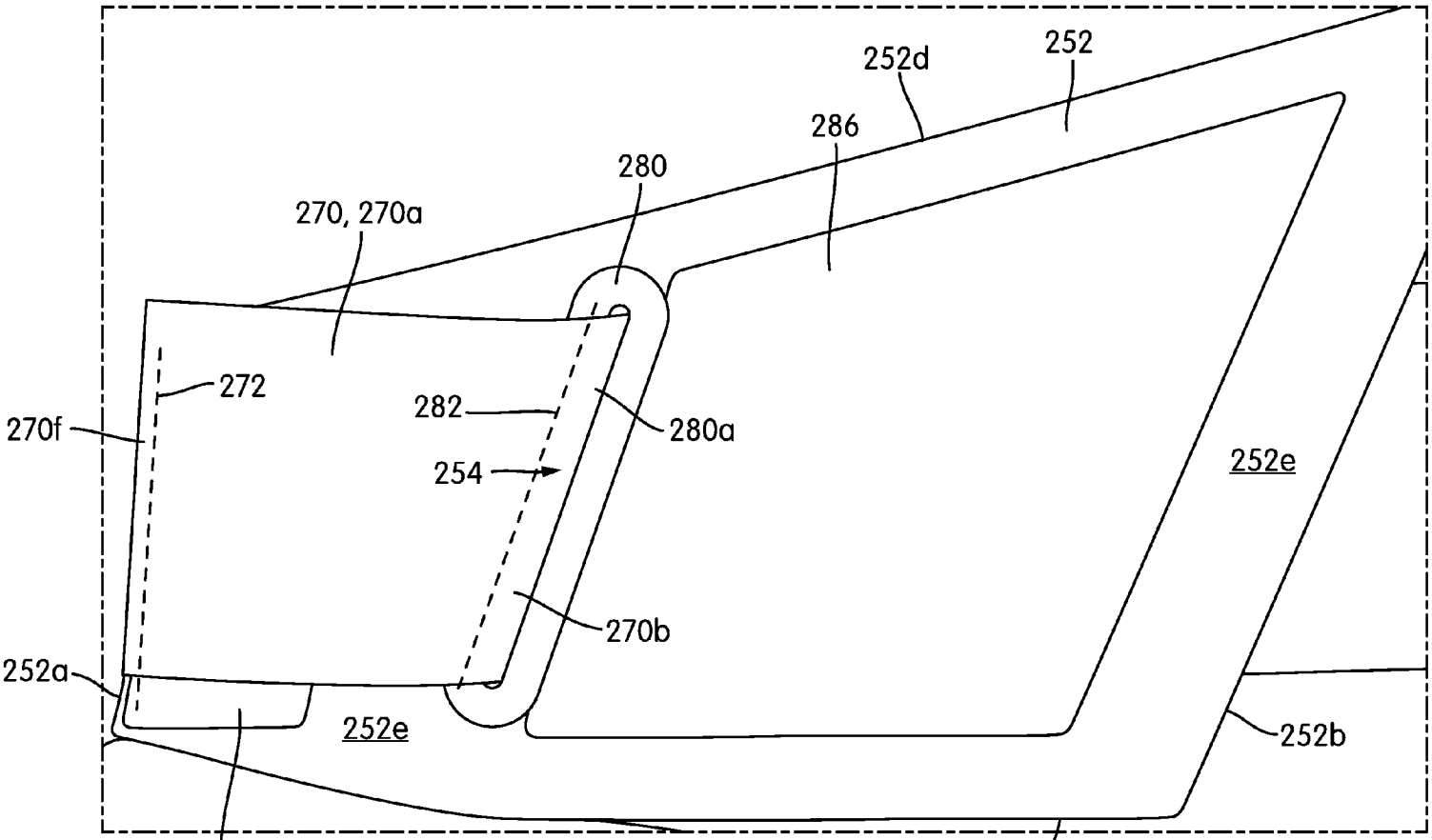
FIG. 2G provides a bottom or interior view of the strap support component of FIG. 2F.
Figure 2H:
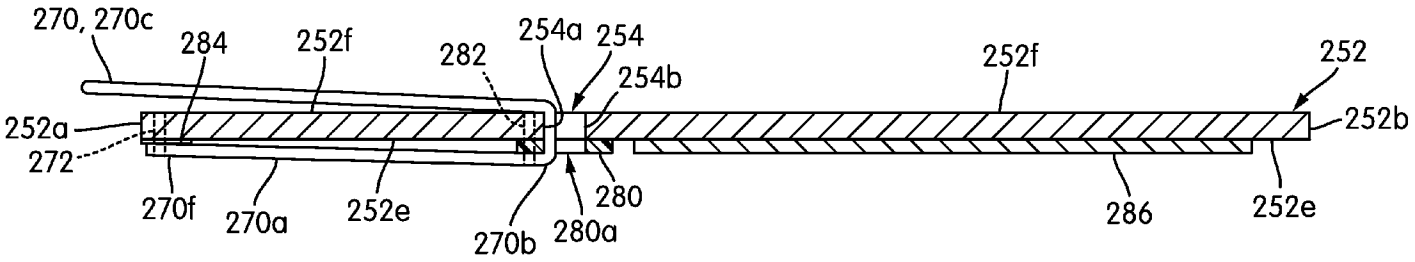
FIG. 2H provides a cross sectional view of the strap support component of FIGS. 2F and 2G.

In the various strap support and upper structures described above, the strap 270 is fed through a slot 254 formed in the strap support 252 and is pulled (a tensile force is applied) against the top edge 254*a* of the slot 254. Depending on the material of the strap support 252 and/or the force applied to it, this tensile force may tend to cause the strap support 252 to tear, particularly at its corners. Accordingly, in at least some examples of this invention, at least some portion(s) of the slot 254 area of the strap support 252 may include a slot reinforcement 280 engaged with it (e.g., and provided adjacent at least a portion of the first edge 254*a* of the slot 254). One example slot reinforcement 280 is illustrated in FIGS. 2G and 2H. The slot reinforcement 280 of this example includes a D-ring type structure in which the opening 280*a* in the D-ring is substantially aligned with the opening defined by the slot 254. In use, the strap 270 is fed through the opening 280*a* in the slot reinforcement 280 and through the slot 254 such that the second portion 270*b* of the strap 270 engages and wraps around the slot reinforcement 280. When the strap 270 is pulled tight, the pulling force may be applied at least primarily to the slot reinforcement 280 rather than against the slot 254 and/or the strap support 252 itself.

While other ways of engaging the slot reinforcement 280 with the strap support 252 may be used without departing from this invention (e.g., including cements, adhesives, or mechanical connectors), in this illustrated example (as shown in FIGS. 2G and 2H), the strap 270, the slot reinforcement 280, and the strap support 252 are engaged together at least at the top edge 254*a* of the slot 254 by sewing or stitching (see seam 282). Optionally, if desired, seam 282 may run completely around the slot 254 (along both edges 254*a* and 254*b*) and the slot reinforcement 280, or two or more seams 282 may be provided around the slot 254 to engage the slot reinforcement 280 with the strap support 252 on both sides of the slot 254. See FIG. 2G. Alternatively, if desired, one seam 282 (or a discontinuous seam) may be provided only on the top side 254*a* of slot 254 (see FIG. 2H). The slot reinforcement 280 may be made from a relatively hard or a relatively tough (e.g., tear resistant) polymer or textile material under forces typically experienced in securing shoes to a wearer's foot, if desired. The slot reinforcement 280 may extend continuously or discontinuously along the slot 254 opening (and optionally at least at the edges or corners of the slot 254).

FIG. 2H provides a cross sectional view of a strap support 252 with a slot 254, strap 270, and slot reinforcement 280 of the general type described and illustrated with respect to FIGS. 2A-2G. As further shown in FIGS. 2G and 2H, if needed, the strap support 252 further may include a seam support component 284 to support seam 272 through the strap 270 at fixed end 270*f* and the top end 252*a* of the strap support 252. This seam support component 284 may simply help prevent the stitches from pulling out or through the materials of the strap 270 and/or the strap support 252.

FIGS. 2G and 2H further show that the first portion 270*a* of the strap 270 extends along the interior surface 252*e* of the strap support 252 from the top end 252*a* to the slot reinforcement 280 and the slot 254. On the other side of the slot 254, the interior surface 252*e* of the strap support 252 of this example includes a spacer fabric 286 engaged with it (e.g., by stitching, by adhesives, etc.). The spacer fabric 286 helps maintain a more consistent thickness for the overall strap support 252 (e.g., the spacer fabric 286 provides additional thickness to the strap support 252 toward end 252*b* to better match the additional thickness provided by seam support 284 (if present), strap portion 270*a*, and/or slot reinforcement 280). This spacer fabric 286, while optional, may help the strap support 252 lie more evenly atop any interior upper components and/or provide a smoother appearing exterior surface when engaged with other upper components and/or incorporated into a shoe 200.

Figure 2I:
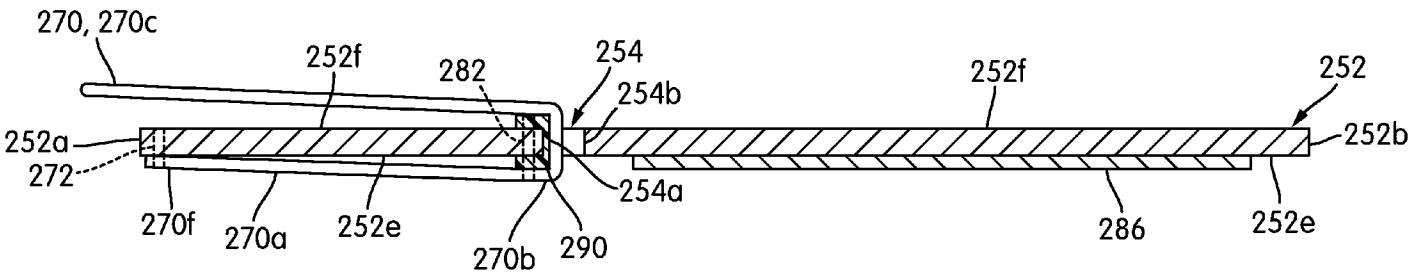
FIGS. 2I through 2L provide cross sectional views of alternative embodiments of strap support components and the slot reinforcements thereof in accordance with some aspects of this invention.

As shown in FIG. 2H, in this illustrated example, the slot reinforcement 280 is provided only at the interior surface 252*e* of the strap support 252. Other slot reinforcement constructions and/or options are possible. For example, as shown in FIG. 2I, a slot reinforcement 290 may be provided that extends around the top edge 254*a* of slot 254, extending from the bottom surface 252*e* to the top surface 252*f* of the strap support 252. This slot reinforcement 290 may constitute a plastic or metal component that is clamped or crimped around the top edge 254*a* of the slot 254. Alternatively, it may constitute a leather, thermoplastic polyurethane, or other relatively tough, thick, and/or tear resistant fabric or textile material, e.g., attached via one or more seams in the manner described above with respect to slot reinforcement 280/seam 282. The slot reinforcement 290 may extend continuously or discontinuously around and/or along the length of the top edge 254*a* of slot 254 opening.

Figure 2J:
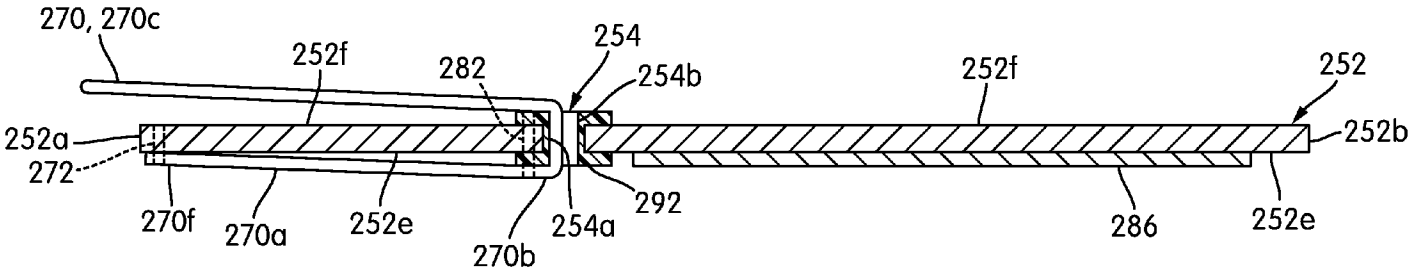

FIG. 2J shows another example slot reinforcement 292 structure in the form of a D-ring or O-ring type structure that extends through the slot 254. This example slot reinforcement 292, however, extends around and along both the top edge 254*a* and bottom edge 254*b* of the slot 254. This example slot reinforcement 292 may extend continuously or discontinuously around and/or along the length of slot 254 opening. The slot reinforcement 292 may be made from any of the noted materials and attached to the remainder of the component parts (e.g., strap support 252 and/or strap 270) in any of the noted manners described above with respect to slot reinforcements 280, 290, and/or in any other desired manner.

Figure 2K:
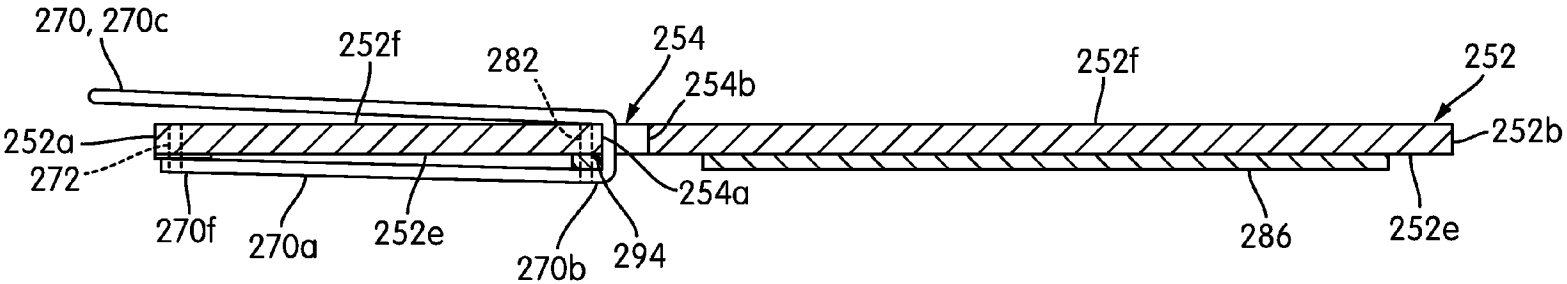

Another example slot reinforcement 294 is shown in FIG. 2K. In this example, slot reinforcement 294 constitutes a band or strip of reinforcing material located along the interior surface 252*e* of the strap support 252 adjacent the top edge 254*a* of slot 254. This reinforcement 294 does not necessarily extend into the opening of slot 254. This example slot reinforcement 294 may extend continuously or discontinuously around and/or along the length of slot 254 opening. The slot reinforcement 294 may be made from any of the noted materials and attached to the remainder of the component parts (e.g., strap support 252 and/or strap 270) in any of the noted manners described above with respect to slot reinforcements 280, 290, and/or in any other desired manner.

Figure 2L:
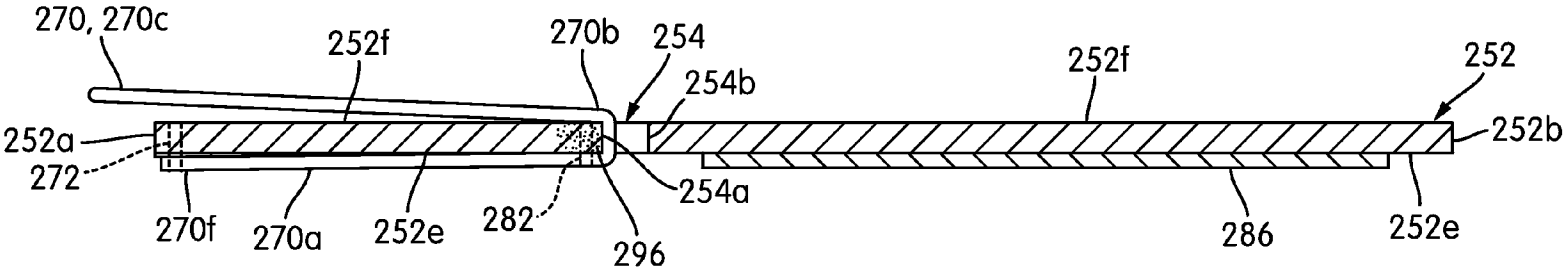

FIG. 2L shows another example slot reinforcement 296, in this instance formed as a coating or an infiltrate applied to at least some portion(s) of the strap support 252. In this illustrated example, the coating or infiltrate 296 is applied along at least some portion of the top edge 254*a* of the slot 254, optionally at least near the corners of the slot 254. The coating or infiltrate 296 may constitute a composition that absorbs into the material of the strap support 252 and/or adheres to the material of the strap support 252 and, when dried (or optionally cured), creates a harder, tougher, and/or more tear-resistant property for the strap support 252. This example slot reinforcement 296 may extend continuously or discontinuously around and/or along the length of slot 254 opening, and it may be provided on both edges 254*a*, 254*b* of the slot 254 opening, if desired. The coating or infiltrate reinforcement 296 may extend over any desired portion or proportion of the strap support 252 construction.

In the various embodiments of the invention shown in FIGS. 2A-2L, the strap 270 has: (a) one end (fixed end 270*f*) fixed adjacent the foot-insertion opening 208 and/or a top, front instep area, (b) a portion 270*a* extending for at least 0.5 inches (and in some examples at least 0.75 inches or even at least 1 inch) along interior surface 252*e* of strap support 252, (c) a portion 270*b* extending through and around slot 254 formed in the strap support 252, and (d) a portion 270*c* that doubles back over exterior surface 252*f* of the strap support 252 (to sandwich a portion of the strap support 252 between portions 270*a* and 270*c* of the strap 270). From there, the strap 270 extends over the instep area of the upper 202 at the front of the foot insertion opening 208 (the top instep area) and is releasably engaged with another portion of the upper 202 to engage the shoe 200 with a wearer's foot. The orientation of the strap 270 in this manner, with the portion 270*c* that "doubles back" over portion 270*a*, helps the user apply a greater tensioning force and helps the user somewhat control the direction of this applied force. The extension of the strap support 252 downward from the slot 254, its generally rectangular or trapezoidal shape, and its extension/orientation in the generally rearward direction (from the top down) also help the pulling force somewhat wrap around the heel and/or ankle area of the foot (at least at the medial side) and help provide a strong, stable feel. When present, the generally rectangular or trapezoidal shape of lateral strap support 260, and its extension/orientation in the generally rearward direction (from the top down), also help the pulling force somewhat wrap around the lateral heel and/or ankle area of the foot and help provide a strong, stable feel at the lateral side, particularly when a tensioning force is applied to the lateral strap support 260.

In other footwear structures in accordance with some examples of this invention, however, the strap 270 need not extend beneath a strap support component and/or between layers of the upper 202. Rather, the fixed end 270*f* could be provided at the exterior surface 252*f* of a strap support 252 or other upper component (e.g., fixed by stitching near the foot-receiving opening 208 and/or forward instep area), and a portion 270*a* thereof could extend along the exterior surface 252*f* for at least 0.5 inches (and in some examples at least 0.75 inches or even at least 1 inch). At this point, the strap 270 could meet a tensioning ring mounted on the strap support 252 or other portion of the upper 202 or footwear 200 structure. The tensioning ring may be formed like the D-rings or O-rings described above (e.g., like strap reinforcement 280, a slotted member, etc.), and it may simply be a structure fixed to or incorporated into the upper 202 around which the strap 270 wraps to change its direction and to enable a tensioning force to be applied. Once it extends around the tensioning ring (at strap portion 270*b*), strap portion 270*c* can extend back over at least some of strap portion 270*a*, over the front instep area, and to the lateral side of the shoe (where its free end 270*g* may be releasably engaged to secure the shoe to a foot, e.g., in the various manners described above).

II. Conclusion

The present invention is disclosed above and in the accompanying drawings with reference to a variety of embodiments and/or options. The purpose served by the disclosure, however, is to provide examples of various features and concepts related to the invention, not to limit the scope of the invention. One skilled in the relevant art will recognize that numerous variations and modifications may be made to the features of the invention described above without departing from the scope of the present invention, as defined by the appended claims.

What is claimed is:

1. An upper for an article of footwear, comprising:

a plurality of upper component parts engaged together to define at least a portion of a foot-receiving chamber, wherein the plurality of upper component parts includes at least:

(a) a first upper component part extending at least along a medial midfoot area of the upper, and (b) a strap support engaged at least with the first upper component part, wherein the strap support includes a first end, a second end opposite the first end, the second end being secured at a bottom edge of the first upper component part, a first surface, a second surface opposite the first surface, and a slot extending from the first surface to the second surface, wherein the slot is defined in the strap support at a location between the first end and the second end, wherein the slot has a first edge and an opposite second edge, and wherein the first edge is located closer to the first end than is the second edge;

a slot reinforcement engaged with the strap support and provided at least adjacent at least a portion of the first edge of the slot; and a strap having a fixed end and a free end opposite the fixed end, wherein the fixed end of the strap is fixed proximate to the first end of the strap support, wherein the strap includes:

(a) a first portion that extends along the first surface of the strap support, (b) a second portion that extends through the slot and around the slot reinforcement, and (c) a third portion that extends beyond the slot reinforcement and toward the free end of the strap, and wherein the slot and the strap are structured and oriented such that when the third strap portion is in an unfolded or untwisted condition, it can lie adjacent the second surface of the strap support such that a portion of the strap support is located between at least some of the first and third portions.

2. An article of footwear, comprising:

an upper according to claim 1; and a sole structure engaged with the upper.

3. An upper for an article of footwear, comprising:

a first upper component part that includes:

(a) a first end located adjacent a medial side of a foot-receiving opening or a front instep area defined by the upper, and a second end opposite the first end and secured at a bottom edge of the upper, (b) a first major surface, (c) a second major surface opposite the first major surface, and (d) a slot defined in the first upper component part and extending from the first major surface to the second major surface, wherein a majority of the slot is defined at least 0.75 inches away from the first end of the first upper component part, wherein the slot has a first edge and an opposite second edge, and wherein the first edge is located closer to the first end than is the second edge; and a strap having a fixed end and a free end opposite the fixed end, wherein the fixed end of the strap is fixed proximate to the first end of the first component part, and wherein the strap includes:

(a) a first portion that extends along the first major surface of the first upper component, (b) a second portion that extends through the slot and around the first edge of the slot, and (c) a third portion that extends beyond the slot and toward the free end of the strap.

4. The upper for an article of footwear according to claim 3, wherein the slot and the strap are structured and oriented such that when the third portion is in an unfolded or untwisted condition, it can lie adjacent the second major surface of the first upper component such that a portion of the first upper component part is located between at least some of the first and third portions.

5. The upper for an article of footwear according to claim 3, further comprising:

a slot reinforcement provided at least adjacent at least a portion of the first edge of the slot.

6. The upper for an article of footwear according to claim 5, wherein the second portion of the strap wraps around the slot reinforcement.

7. The upper for an article of footwear according to claim 5, wherein the slot reinforcement includes a coating or an infiltrate applied to the first upper component part at least at the portion of the first edge of the slot.

8. The upper for an article of footwear according to claim 5, wherein the slot reinforcement is engaged with the first upper component part.

9. The upper for an article of footwear according to claim 3, wherein the third portion of the strap, at a location closer to the free end than the fixed end, includes a first portion of a fastening device, and wherein the upper further includes:

a second portion of the fastening device engaged with the first upper component part or another upper component part, wherein the first and second portions of the fastening device are provided for releasably securing the upper with a wearer's foot.

10. The upper for an article of footwear according to claim 3, wherein the first portion of the strap extends along the first major surface of the first upper component part for a distance of at least 0.75 inches.

11. An article of footwear, comprising:

an upper according to claim 3; and a sole structure engaged with the upper.

12. An upper for an article of footwear, comprising:

a plurality of upper component parts engaged together to define at least a portion of a foot-receiving chamber, wherein the plurality of upper component parts includes at least:

(a) a first upper component part extending at least along a medial midfoot area of the upper, (b) a strap support engaged with the first upper component part and including:

(i) a first end located adjacent a medial side of a foot-receiving opening or a front instep area defined by the upper, (ii) a second end secured along a bottom, medial heel area of the upper, (iii) a first edge extending between the first end and the second end and located along a medial heel area of the upper, (iv) a second edge extending between the first end and the second end and located along the medial heel area of the upper, wherein the first edge is located closer to a rear heel area of the upper than is the second edge and the second edge is located closer to a toe area of the upper than is the first edge, (v) a first major surface, (vi) a second major surface opposite the first major surface, and (vii) a slot defined in the strap support and extending from the first major surface to the second major surface, wherein the slot is defined in the strap support at a location between the first end and the second end, wherein the slot has a first edge and an opposite second edge, and wherein the first edge of the slot is located closer to the first end than is the second edge of the slot, and (c) a slot reinforcement engaged with the strap support and provided at least adjacent the first edge of the slot; and a strap having a fixed end and a free end opposite the fixed end, wherein the fixed end of the strap is fixed proximate to the first end of the strap support, wherein the strap includes:

(a) a first portion that extends along the first major surface of the strap support, (b) a second portion that extends through the slot and around the slot reinforcement, and (c) a third portion located outside of the slot that extends beyond the slot reinforcement and toward the free end of the strap.

13. The upper for an article of footwear according to claim 12, wherein the slot and the strap are structured and oriented such that when the third portion is in an unfolded or untwisted condition, it can lie adjacent the second major surface of the strap support such that a portion of the strap support is located between at least some of the first and third portions.

14. The upper for an article of footwear according to claim 12, wherein the third portion of the strap, at a location closer to the free end than the fixed end, includes a first portion of a fastening device, and wherein the upper further includes:

a second portion of the fastening device engaged with one of the plurality of upper component parts, wherein the first and second portions of the fastening device are provided for releasably securing the upper with a wearer's foot.

15. The upper for an article of footwear according to claim 12, wherein the first portion of the strap extends along the first major surface of the strap support for a distance of at least 0.75 inches.

16. The upper for an article of footwear according to claim 12, wherein one of the plurality of upper component parts includes a lateral heel component having:

a first end located adjacent a lateral side of the foot-receiving opening or a front instep area defined by the upper, a second end located proximate a bottom, lateral heel area of the upper, a first edge extending between the first end and the second end of the lateral heel component and located along a lateral heel area of the upper, a second edge extending between the first end and the second end and located along the lateral heel area of the upper, wherein the first edge of the lateral heel component is located closer to the rear heel area of the upper than is the second edge of the lateral heel component and the second edge of the lateral heel component is located closer to the toe area of the upper than is the first edge of the lateral heel component.

17. The upper for an article of footwear according to claim 16, wherein the third portion of the strap, at a location closer to the free end than the fixed end, includes a first portion of a fastening device, and wherein the lateral heel component further includes a second portion of the fastening device, wherein the first and second portions of the fastening device are provided for releasably securing the upper with a wearer's foot.

18. An article of footwear, comprising:

an upper according to claim 12; and a sole structure engaged with the upper.

19. An upper for an article of footwear, comprising:

a plurality of upper component parts engaged together to define at least a portion of a foot-receiving chamber, wherein the plurality of upper component parts includes at least:

(a) a first upper component part extending at least along a medial midfoot area of the upper, (b) a strap support engaged with the first upper component part and including:

(i) a first end located adjacent a medial side of a foot-receiving opening or a front instep area defined by the upper, (ii) a second end secured along a bottom, medial heel area of the upper, (iii) a first edge extending between the first end and the second end and located along a medial heel area of the upper, and (iv) a second edge extending between the first end and the second end and located along the medial heel area of the upper, wherein the second edge is located closer to a toe area of the upper than is the first edge;

a strap tensioning element engaged with the strap support between the first end and the second end; and a strap having a fixed end and a free end opposite the fixed end, wherein the fixed end of the strap is fixed proximate to the first end of the strap support, wherein the strap includes a first portion that extends from the fixed end to the strap tensioning element, a second portion that extends around the strap tensioning element, and a third portion located beyond the strap tensioning element that extends toward the free end of the strap, and wherein the strap wraps around the strap tensioning element such that when the third portion of the strap is in an unfolded or untwisted condition, at least some of the third portion of the strap can overlap the first portion of the strap.

20. The upper for an article of footwear according to claim 19, wherein a portion of the strap support separates the first strap portion and the third strap portion at the overlap.

21. The upper for an article of footwear according to claim 19, wherein the strap tensioning element includes a slot formed in the strap support.

22. The upper for an article of footwear according to claim 19, wherein the strap tensioning element includes a ring, a partial ring, or a slotted member around which the second portion of the strap wraps.

23. An article of footwear, comprising:

an upper according to claim 19; and a sole structure engaged with the upper.

* * * * *